US009121332B2

(12) United States Patent
Araki et al.

(10) Patent No.: US 9,121,332 B2
(45) Date of Patent: Sep. 1, 2015

(54) WARMUP ACCELERATION DEVICE FOR INTERNAL COMBUSTION ENGINE

(75) Inventors: Yukari Araki, Chiryu (JP); Takasuke Shikida, Okazaki (JP)

(73) Assignee: TOYOTA JIDOSHA KABUSHIKI KAISHA, Toyota-Shi (JP)

( * ) Notice: Subject to any disclaimer, the term of this patent is extended or adjusted under 35 U.S.C. 154(b) by 0 days.

(21) Appl. No.: 14/002,315

(22) PCT Filed: Mar. 3, 2011

(86) PCT No.: PCT/JP2011/054926
§ 371 (c)(1),
(2), (4) Date: Aug. 29, 2013

(87) PCT Pub. No.: WO2012/117554
PCT Pub. Date: Sep. 7, 2012

(65) Prior Publication Data

US 2013/0333641 A1 Dec. 19, 2013

(51) Int. Cl.

| | |
|---|---|
| ***F01P 7/16*** | (2006.01) |
| ***F01P 7/00*** | (2006.01) |
| ***F01P 9/02*** | (2006.01) |
| *F01P 3/02* | (2006.01) |

(52) U.S. Cl.
CPC ... *F01P 7/00* (2013.01); *F01P 9/02* (2013.01); *F01P 7/162* (2013.01); *F01P 7/164* (2013.01); *F01P 2003/027* (2013.01); *F01P 2003/028* (2013.01); *F01P 2037/02* (2013.01)

(58) Field of Classification Search
CPC ..... F01P 3/22; F01P 7/16; F01P 7/164; F01P 7/167; F01P 2003/027–2003/028
USPC ..... 123/41.02, 41.08, 685
See application file for complete search history.

(56) References Cited

U.S. PATENT DOCUMENTS

| | | | | |
|---|---|---|---|---|
| 4,768,484 | A * | 9/1988 | Scarselletta | 123/41.21 |
| 7,263,954 | B2 * | 9/2007 | Piddock et al. | 123/41.09 |
| 7,673,591 | B2 * | 3/2010 | Vuk | 123/41.02 |

FOREIGN PATENT DOCUMENTS

| | | | |
|---|---|---|---|
| DE | 4342292 | A1 | 6/1995 |
| JP | 61083444 | A | 4/1986 |
| JP | 04022708 | A | 1/1992 |
| JP | 2005507047 | A | 3/2005 |
| JP | 2008-157090 | A | 7/2008 |
| JP | 2008-169750 | A | 7/2008 |
| JP | 2008-303775 | A | 12/2008 |
| JP | 2009-121339 | A | 6/2009 |
| JP | 2010-196518 | A | 9/2010 |

* cited by examiner

*Primary Examiner* — Lindsay Low
*Assistant Examiner* — Kevin Lathers
(74) *Attorney, Agent, or Firm* — Kenyon & Kenyon LLP

(57) ABSTRACT

When the passing of coolant in an internal combustion engine is restricted to accelerate the warm-up of the internal combustion engine and the coolant in this engine is undergoing nucleate boiling, the restriction of the passing of the coolant in the internal engine is maintained. Specifically, the restriction of the passing of the coolant in the internal combustion engine is maintained during nucleate boiling from the beginning of nucleate boiling of the coolant in the internal combustion engine until the maintenance period has elapsed. Thus, the warm-up of the internal combustion engine is effectively accelerated by restricting the passing of the coolant in the engine. Furthermore, the restriction of the passing of the coolant in the internal combustion engine is canceled when the maintenance period has elapsed. Thus, low-temperature coolant flows in the internal combustion engine and the internal combustion engine is cooled by this coolant, so nucleate boiling of the coolant in the engine is suppressed.

7 Claims, 5 Drawing Sheets

WARMUP ACCELERATION DEVICE FOR INTERNAL COMBUSTION ENGINE

CROSS REFERENCE TO RELATED APPLICATION

This is a national phase application based on the PCT International Patent Application No. PCT/JP2011/054926 filed on Mar. 3, 2011, the entire contents of which are incorporated herein by reference.

FIELD OF THE DISCLOSURE

The present invention relates to a warm-up acceleration device for an internal combustion engine.

BACKGROUND OF THE DISCLOSURE

An internal combustion engine mounted on a vehicle like an automobile performs cooling with a coolant to suppress an excessive temperature rise accompanying engine operation. The coolant circulates through circulation passages, thereby flowing through the interior of the internal combustion engine. When the coolant flows through the interior of the internal combustion engine, heat transfer takes place between the coolant and the internal combustion engine, and thus the internal combustion engine is cooled.

When an internal combustion engine is subjected to warm-up at the time of, for example, engine start-up, it is preferable to restrict the flow of the coolant through the interior of the internal combustion engine to complete the engine warm-up as early as possible. For example, Patent Document 1 discloses that the flow of the coolant through the interior of the internal combustion engine is restricted by deactivating a pump that circulates the coolant. When the flow of the coolant through the interior of the internal combustion engine is restricted during the engine warm-up, the warm-up is accelerated and can be completed early.

Moreover, Patent Document 1 discloses that while the flow of the coolant through the interior of the internal combustion engine is restricted, it is determined whether or not the warm-up of the internal combustion engine has completed based on the temperature of the coolant detected by a coolant temperature sensor, an accumulated value of the intake air amount by the internal combustion engine, and the accumulated value of the time during which the above-described restriction is performed. Furthermore, Patent Document 1 discloses that when it is determined that the warm-up has been completed through the above-described determination on whether or not the engine warm-up has completed, the flow restriction of the coolant through the interior of the internal combustion engine is canceled.

PRIOR ART DOCUMENT

Patent Document

Patent Document 1: Japanese Laid-Open Patent Publication No. 2008-169750 (paragraphs [0040] to [0053] and FIG. 2)

SUMMARY OF THE INVENTION

Problems that the Invention is to Solve

When, like Patent Document 1, the engine warm-up is accelerated by restricting the flow of the coolant through the interior of the internal combustion engine, in order to prevent the coolant in the internal combustion engine from being boiled, the restriction may be canceled before the coolant is boiled. More specifically, it is determined that the warm-up has completed while the temperature of the internal combustion engine is relatively low to reliably carry out, before the coolant in the internal combustion engine is boiled, the determination on whether or not the warm-up of the internal combustion engine has completed based on the temperature of the coolant detected by the coolant temperature sensor, the accumulated value of the intake air amount by the internal combustion engine, and the accumulated time during which the above-described restriction is performed.

In this case, it is possible to prevent the coolant in the internal combustion engine from being boiled. However, since the flow restriction of the coolant through the interior of the internal combustion engine is canceled while the temperature of the internal combustion engine is relatively low, the coolant passing through the interior of the internal combustion engine draws heat from the internal combustion engine after the restriction is canceled, and thus the acceleration of the warm-up of the internal combustion engine is disrupted. Hence, there is room for further improvement of accomplishing a sufficient warm-up acceleration effect of the internal combustion engine through the flow restriction of the coolant through the interior of the internal combustion engine.

Accordingly it is an objective of the present invention to provide an internal-combustion-engine warm-up acceleration device that makes the acceleration of an internal combustion engine warm-up through flow restriction of coolant through the interior of the internal combustion engine further effective.

Means for Solving the Problems

In order to achieve the above objective, the warm-up acceleration device for an internal combustion engine of the present invention includes a controller that controls the flow of coolant through the internal combustion engine that circulates in a circulation passage. The controller maintains the flow restriction of the coolant through the internal combustion engine when the coolant in the internal combustion engine is nucleate boiling while the flow of the coolant through the internal combustion engine is restricted. in the process of boiling caused by a temperature rise, the coolant first starts nucleate boiling as an initial stage of the boiling. Then, the boiling state of the coolant shifts to film boiling from nucleate boiling. Nucleate boiling is a boiling phenomenon in which bubbles of water steam at a certain nucleation site on a heat transfer surface to the coolant. Film boiling is a boiling phenomenon in which the temperature of the coolant rises from the nucleate boiling state, the number of bubbles of water steam increases, and a film of water steam is formed on the transfer surface by those bubbles. For the coolant in the internal combustion engine during a warm-up, the boiling phenomenon that must be avoided so that an abnormality in the internal combustion engine does not occur is film boiling. In contrast, while the coolant in the internal combustion engine is nucleate boiling, if the flow of the coolant through the internal combustion engine is restricted, nucleate boiling does not cause an abnormality of the internal combustion engine. It is thus preferable to perform such a restriction in order to accelerate the warm-up of the internal combustion engine. Hence, when the coolant in the internal combustion engine is nucleate boiling while the flow of the coolant through the internal combustion engine is restricted, the controller maintains the flow restriction of the coolant through the internal combustion engine as described above, thereby making the warm-up acceleration of the internal combustion engine further effective by restricting the flow of the coolant through the internal combustion engine.

According to one aspect of the present invention, the controller maintains the flow restriction of the coolant through the internal combustion engine during nucleate boiling from when nucleate boiling occurs until a maintaining time has elapsed while the flow of the coolant through the internal combustion engine is maintained. Moreover, the maintaining time is set to be a period at which pressure in the circulation passage is a value indicating the occurrence of nucleate boiling. The pressure in the circulation passage has a correlation with nucleate boiling of the coolant in the internal combustion engine. Hence, the maintaining time is set to be a period at which the pressure in the circulation passage is a value indicating the occurrence of nucleate boiling, and the flow of the coolant through the internal combustion engine is restricted during such a maintaining time. Accordingly, the flow restriction of the coolant through the internal combustion engine is maintained during the occurrence of nucleate boiling.

Furthermore, the maintaining time may be set to be a period at which the temperature of the coolant in the internal combustion engine is a value indicating the occurrence of nucleate boiling. The temperature of the coolant in the internal combustion engine also has a correlation with nucleate boiling of the coolant. Hence, the maintaining time is set to be a period at which the temperature of the coolant is a value indicating the occurrence of nucleate boiling, and the flow of the coolant through the internal combustion engine is restricted during such a maintaining time. Accordingly, the flow restriction of the coolant through the internal combustion engine is maintained during the occurrence of nucleate boiling.

According to another aspect of the present invention, the controller includes a flow control valve that controls a flow rate of the coolant flowing through the internal combustion engine, and the controller drives the flow control valve in the closing direction to restrict the flow of the coolant through the internal combustion engine. In this case, when the coolant in the internal combustion engine is nucleate boiling while the flow of the coolant through the internal combustion engine is restricted, the flow control valve is driven and maintained in the close side. Accordingly, the flow restriction of the coolant through the internal combustion engine is maintained.

According to another aspect of the present invention, the controller is a pressure valve that controls a flow rate of the coolant flowing through the internal combustion engine based on the pressure in the circulation passage. The pressure valve receives the pressure in the circulation passage and maintains a condition being driven in the closing direction when the pressure in the circulation passage is a value indicating the occurrence of nucleate boiling, thereby maintaining the flow restriction of the coolant through the internal combustion engine. As a result, the pressure valve maintains the flow restriction of the coolant through the internal combustion engine during nucleate boiling until the maintaining time has elapsed after the coolant in the internal combustion engine starts nucleate boiling while the flow of the coolant through the internal combustion engine is restricted. The pressure valve sets the maintaining time to be a period at which the pressure in the circulation passage is a value indicating the occurrence of nucleate boiling. By causing the pressure valve to restrict the flow of the coolant through the internal combustion engine during the maintaining time, the flow restriction of the coolant through the internal combustion engine is maintained while nucleate boiling is occurring. Such a pressure valve realizes the restriction without the need of, for example, a detection of a pressure by a pressure sensor, and thus it is unnecessary to provide a pressure sensor. Hence, the manufacturing costs of the device can be reduced by an amount corresponding to the unnecessary pressure sensor.

According to another aspect of the present invention, the controller includes a pump that is capable of controlling the flow rate of the coolant flowing through the internal combustion engine, and the controller decreases the discharge rate of the coolant by the pump to restrict the flow of the coolant through the internal combustion engine. In this case, when the coolant in the internal combustion engine is nucleate boiling while the flow of the coolant through the internal combustion engine is restricted, a condition in which the discharge rate of the coolant by the pump is reduced is maintained. Thus, the flow restriction of the coolant through the internal combustion engine is maintained. Moreover, when the pump is also utilized as a pump that circulates the coolant through the circulation passage, it becomes unnecessary to provide an additional component like a valve that restricts the flow of the coolant through the internal combustion engine, and thus the device can be downsized. This facilitates mounting of the warm-up acceleration device.

According to another aspect of the present invention, the maintaining time is set to be a period from when nucleate boiling occurs in the coolant in the internal combustion engine until the boiling state of the coolant shifts to film boiling. In this case, the flow restriction of the coolant through the internal combustion engine can be maintained over the whole period at which the coolant in the internal combustion engine is nucleate boiling. Hence, the restriction is maintained as long period as possible, thereby maximizing the warm-up acceleration effect of the internal combustion engine by such a restriction.

According to another aspect of the present invention, the circulation passage includes a first passage that passes through a cylinder head of the internal combustion engine and a second passage that passes through a cylinder block of the internal combustion engine. The controller restricts a flow of the coolant in the second passage through the cylinder block. In this case, in the internal combustion engine, the temperature of the cylinder head is easily increased by heat from the combustion gas in a combustion chamber, while the temperature of the cylinder block is hard to increase since it is not likely to be affected by heat from the combustion gas. However, by causing the controller to restrict the flow of the coolant through the cylinder block, the effective warm-up (temperature rise) of the cylinder block, the temperature of which is hard to increase, is realized.

DETAILED DESCRIPTION OF THE PREFERRED EMBODIMENTS

First Embodiment

A warm-up acceleration device for an internal combustion engine mounted on a vehicle like an automobile according to a first embodiment of the present invention will be described below with reference to FIGS. 1 to 3.

Figure 1:
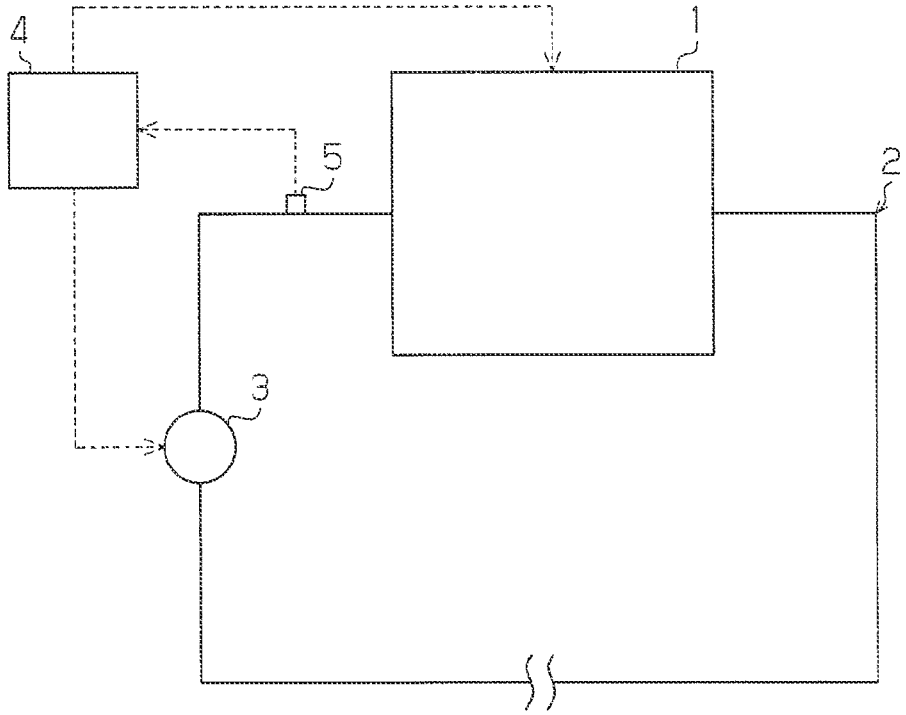
FIG. 1 is a schematic diagram illustrating a whole warm-up acceleration device according to a first embodiment.

An internal combustion engine 1 illustrated in FIG. 1 is cooled by a coolant circulating through a circulation passage 2. More specifically, when the coolant circulates through the circulation passage 2 and flows through the internal combustion engine 1, heat exchange takes place between the coolant and the internal combustion engine 1, and thus the internal combustion engine 1 is cooled. The circulation passage 2 is provided with a variable pump 3 that is capable of controlling the flow rate of the coolant circulating in the interior of the circulation passage 2. An electric water pump may be employed as the pump 3.

The warm-up acceleration device of this embodiment includes an electronic control device 4 that controls various operations of the internal combustion engine 1. The electronic control device 4 includes a CPU that executes various arithmetic processes related to the above-described control, a ROM storing programs and data necessary for such control, a RAM temporally storing a computation result, by the CPU, and an input/output port for inputting/outputting signals from/to the exterior. The input port of the electronic control device 4 is coupled with various sensors like a pressure sensor 5 that detects pressure (system pressure) P in the circulation passage 2, and the output port of the electronic control device 4 is coupled with drive circuits for various devices like a drive circuit for the pump 3. The pump 3 and the electronic control device 4 serve as a controller that controls the flow of the coolant through the internal combustion engine 1. The pressure sensor 5 can be provided at an arbitrary location in the circulation passage 2 regardless of the installation location of the circulation passage 2. This is because a pressure rise due to boiling is instantaneously transmitted to the entire system in the case of a continuous system that is the circulation passage 2, and thus the pressure sensor 5 is capable of accurately measuring pressure in the circulation passage 2 regardless of the installation location (a location where pressure is measured) of the pressure sensor 5 in the circulation passage 2.

When the temperature of the internal combustion engine 1 is low like at the time of engine start-up and the internal combustion engine 1 is subjected to warm-up, the electronic control device 4 restricts the flow of the coolant through the internal combustion engine 1 to complete the warm-up as early as possible. More specifically, the electronic control device 4 deactivates the pump 3, thereby reducing the flow rate of the coolant flowing through the internal combustion engine 1 to be zero. In this case, the coolant flowing through the internal combustion engine 1 is prevented from drawing heat from the internal combustion engine 1, and thus the warm-up of the internal combustion engine 1 is accelerated. In contrast, the coolant present in the internal combustion engine 1 receives heat from the engine 1 and its temperature is gradually raised.

When the condition in which the flow of the coolant through the internal combustion engine 1 is maintained as it is, the coolant present in the internal combustion engine 1 is boiled due to a temperature rise caused by heat from the internal combustion engine 1. More specifically, first, nucleate boiling as an initial stage of the boiling of the coolant occurs. Then, the boiling state of the coolant shifts from nucleate boiling to film boiling. Nucleate boiling is a boiling phenomenon in which bubbles of water steam are produced at a certain nucleation site on the heat transfer surface of the internal combustion engine 1, at which heat is transferred to the coolant. Film boiling is a boiling phenomenon in which the temperature of the coolant rises from the nucleate boiling state, the number of bubbles of water steam increases, and a film of water steam is formed by such bubbles on the transfer surface.

The boiling phenomenon that must be avoided so that an abnormality does not occur in the internal combustion engine 1 in the internal combustion engine 1 during the warm-up is film boiling. In contrast, while nucleate boiling of the coolant in the internal combustion engine 1 is occurring, nucleate boiling does not bring about any abnormality in the internal combustion engine 1 even if the flow of the coolant through the internal combustion engine 1 is restricted, and thus it is preferable to perform such a restriction from the standpoint of acceleration of the warm-up of the internal combustion engine 1. In consideration of those facts, according to the warm-up acceleration device of this embodiment, when the coolant in the internal combustion engine 1 is nucleate boiling while the flow of the coolant through the internal combustion engine 1 is restricted, the flow restriction of the coolant through the internal combustion engine 1 is maintained. Accordingly, the warm-up acceleration by restricting the flow of the coolant through the internal combustion engine 1 can be made effective.

Next, a description will be given of the flow restriction of the coolant through the internal combustion engine 1 to make the warm-up acceleration effective with reference to FIG. 2.

Figure 2:
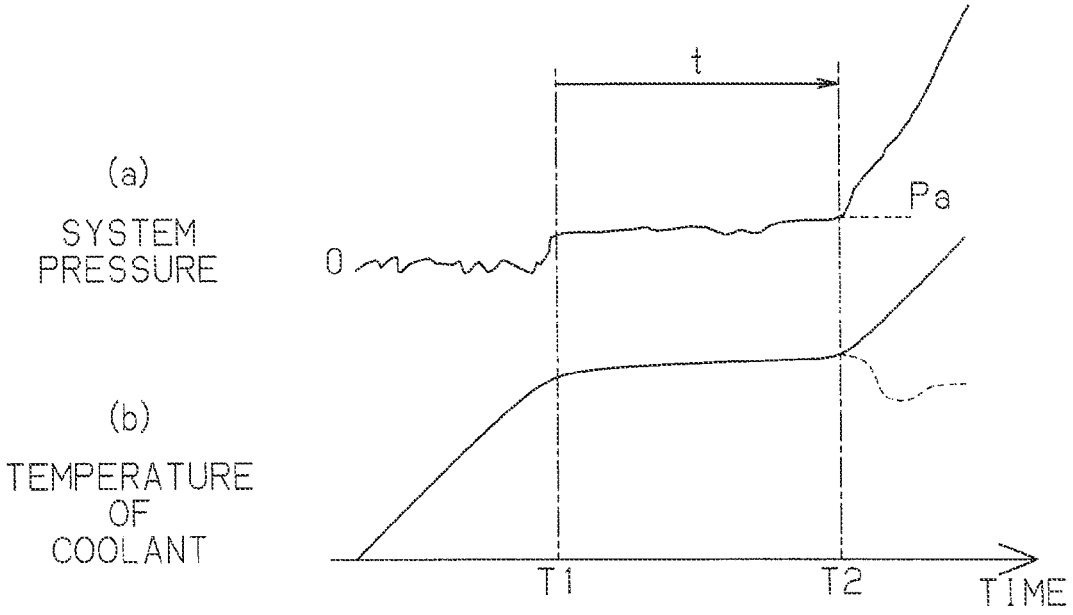
FIGS. 2(*a*) and 2(*b*) are time charts illustrating changes in pressure in a circulation passage (system pressure) and changes in the temperature of a coolant in an internal combustion engine over time.

While the flow of the coolant through the internal combustion engine 1 is restricted during the warm-up of the internal combustion engine 1, the system pressure P (pressure in the circulation passage 2) changes as indicated by a solid line in FIG. 2(*a*) as time advances, and the temperature of the coolant in the internal combustion engine 1 changes as indicated by a solid line in FIG. 2(*b*) as time advances. As is clear from those drawings, when the flow of the coolant through the internal combustion engine 1 is restricted to accelerate the warm-up of the internal combustion engine 1, the coolant present in the internal combustion engine 1 receives heat from the internal combustion engine 1 and is subjected to a temperature rise as illustrated in FIG. 2(*b*). The coolant starts nucleate boiling due to such a temperature rise (timing T1). Subsequently, when the condition in which the flow of the coolant through the internal combustion engine 1 is restricted is maintained, the coolant in the internal combustion engine 1 receives heat from the internal combustion engine 1, and the boiling state of the coolant shifts to film boiling from nucleate boiling (timing T2).

During the period (Ti to T2) in which the boiling state of the coolant changes to a film boiling after the coolant in the internal combustion engine 1 starts nucleate boiling, the system pressure P (pressure in the circulation passage 2) becomes substantially constant illustrated in FIG. 2(*a*), and the temperature of the coolant in the internal combustion engine 1 becomes substantially constant illustrated in FIG. 2(*b*). More precisely, during such a period, the system pressure P gradually increases in a condition slightly greater than zero, while at the same time, the temperature of the coolant in the internal combustion engine 1 gradually increases. Next, when the boiling state of the coolant in the internal combustion engine 1 shifts from nucleate boiling to film boiling (T2), the increase speed of the system pressure P (the inclination of the solid line in FIG. 2(*a*)) sharply increases, and the increase speed of the temperature of the coolant in the internal combustion engine 1 (the inclination of the solid line in FIG. 2(*b*)) also sharply increases.

The electronic control device 4 restricts the flow of the coolant through the internal combustion engine 1 before the coolant in the internal combustion engine 1 during the warm-up starts nucleate boiling (before T1). Further, during nucleate boiling until a maintaining time t elapses after nucleate boiling of the coolant has occurred, the flow control of the coolant through the internal combustion engine 1 is maintained. Accordingly, the warm-up of the internal combustion engine 1 is accelerated. Moreover, when the maintaining time t has elapsed after nucleate boiling of the coolant in the internal combustion engine 1 occurs, the electronic control device 4 cancels the flow restriction of the coolant through the internal combustion engine 1. That is, by activating the pump 3 in FIG. 1 in the deactivated state, the flow rate of the coolant passing through the internal combustion engine 1 is increased to be a value greater than zero, e.g., an appropriate value to the engine operation at this time. When the flow restriction of the coolant through the internal combustion engine 1 is canceled in this manner, the coolant with a low temperature flows in the internal combustion engine 1, and the internal combustion engine 1 is cooled by such a coolant. Hence, the coolant in the internal combustion engine 1 is prevented from film boiling due to heat from the internal combustion engine 1. The changes in the temperature of the coolant over time when the flow restriction of the coolant through the internal combustion engine 1 is canceled are represented by, for example, a broken line in FIGS. 2(*b*).

The above-described maintaining time t is defined as a period at which the system pressure P is a value indicating an occurrence of nucleate boiling of the coolant in the internal combustion engine 1, more specifically, a period until the boiling state of the coolant shifts to film boiling after the coolant starts nucleate boiling. In order to realize the flow restriction of the coolant through the internal combustion engine 1 until the maintaining time t has elapsed, the restriction is performed when the system pressure P is less than a determination value Pa indicated in FIG. 2(*a*). The determination value Pa is set in advance, for example, through experimentation, in such a manner as to be equivalent to the pressure in the circulation passage 2 at a time point (T2) when the boiling state of the coolant in the internal combustion engine 1 shifts from nucleate boiling to film boiling.

Figure 3:
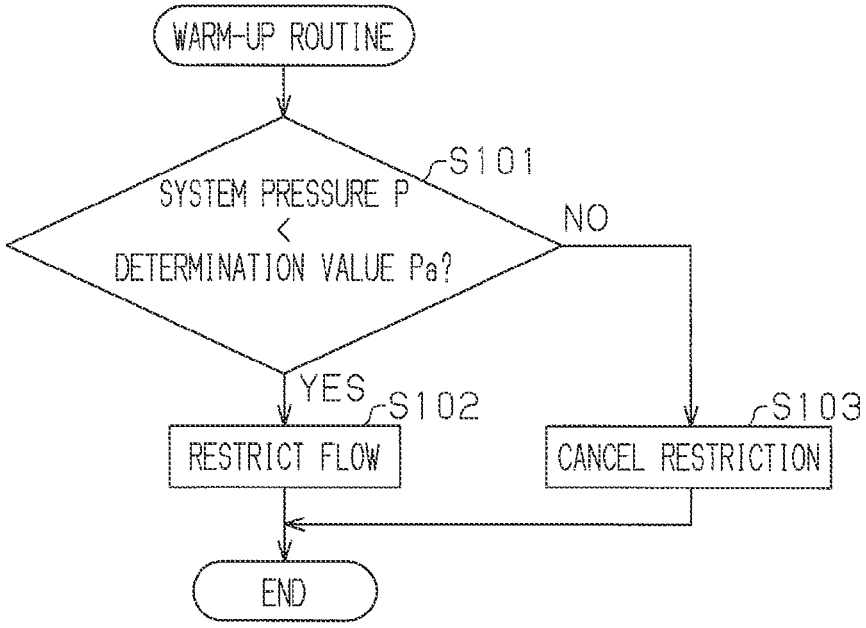
FIG. 3 is a flowchart illustrating procedures of restricting the flow of a coolant through an internal combustion engine and canceling such a restriction according to the first embodiment.

FIG. 3 is a flowchart illustrating a warm-up routine for restricting the flow of the coolant through the internal combustion engine 1 based on the system pressure P and for canceling such a restriction. This warm-up routine is periodically executed by, for example, a time interruption for each predetermined time cycle by the electronic control device 4. According to this routine, first, it is determined whether or not the system pressure P is less than the determination value Pa (S101). When the determination result at this stage is positive, this indicates that the coolant in the internal combustion engine 1 is in a state immediately before film boiling, and thus the flow of the coolant through the internal combustion engine 1 is restricted (S102) in order to accelerate the warm-up of the internal combustion engine 1. More specifically, by deactivating the pump 3, the flow rate of the coolant flowing through the internal combustion engine 1 is reduced to be zero. In this state, the coolant in the internal combustion engine 1 has the temperature raised due to heat from the internal combustion engine 1, and the system pressure P also increases. Next, when the system pressure P becomes equal to or greater than the determination value Pa and the determination result in S101 becomes negative, the flow restriction of the coolant through the internal combustion engine 1 is canceled (S103) in order to suppress a film boiling of the coolant in the internal combustion engine 1. More specifically, by starting the activation of the deactivated pump 3, the flow rate of the coolant flowing through the internal combustion engine 1 is increased to be a greater value than zero.

According to the above-described embodiment, the following advantages are achieved.

(1) When the coolant in the internal combustion engine 1 is nucleate boiling while the flow of the coolant through the internal combustion engine 1 is restricted in order to accelerate the warm-up of the internal combustion engine 1, the flow restriction of the coolant through the internal combustion engine 1 is maintained. More specifically, the flow restriction of the coolant through the internal combustion engine 1 is maintained during nucleate boiling until the maintaining time t has elapsed after the coolant in the internal combustion engine 1 starts nucleate boiling. Accordingly, the acceleration of the warm-up of the internal combustion engine 1 by restricting the flow of the coolant through the internal combustion engine 1 is made effective.

(2) The maintaining time t is set to be a period at which the system pressure P is a value indicating the occurrence of nucleate boiling of the coolant in the internal combustion engine 1. The system pressure P has a correlation with nucleate boiling of the coolant in the internal combustion engine 1. Accordingly, when the maintaining time t is set to be a period at which the system pressure P is a value indicating the occurrence of nucleate boiling and the flow of the coolant through the internal combustion engine 1 is restricted during that maintaining time t, the flow restriction of the coolant through the internal combustion engine 1 can be maintained while nucleate boiling is occurring.

The system pressure P detected by the pressure sensor 5 is an accurate value that is not affected by the installation location of the pressure sensor 5, and thus the maintaining time t set based on this system pressure P can be an appropriate period at which nucleate boiling is occurring. In contrast, if the temperature of the coolant in the circulation passage 2 is detected by a coolant temperature sensor and the maintaining time t is set to be a period at which the coolant temperature is a value indicating the occurrence of nucleate boiling, the maintaining time t becomes an inappropriate period for indicating the occurrence of nucleate boiling in some cases. This is because the temperature of the coolant in the circulation passage 2 varies depending on the location in the circulation passage 2 during the flow restriction of the coolant through the internal combustion engine 1. Depending on the installation location of the coolant temperature sensor in the circulation passage 2, the maintaining time t set based on the temperature of the coolant detected by the coolant temperature sensor may become an inappropriate period for indicating the occurrence of nucleate boiling. According to the present embodiment, however, the maintaining time t is set to be a period at which the system pressure P detected by the pressure sensor 5 is a value indicating the occurrence of nucleate boiling, and thus the above-described disadvantage is avoided.

(3) The maintaining time t, which is a period at which the system pressure P is a value indicating the occurrence of nucleate boiling of the coolant in the internal combustion engine 1, is set to be a period until the boiling state of the coolant is shifted to a film boiling after the coolant starts nucleate boiling. In this case, the flow restriction of the coolant through the internal combustion engine 1 is maintained over the whole period at which the coolant is nucleate boiling in the internal combustion engine 1. Hence, such a restriction is maintained as long as possible, and the warm-up acceleration effect to the internal combustion engine 1 by such a restriction is maximized.

(4) The flow restriction of the coolant through the internal combustion engine 1 is realized by decreasing the flow rate (corresponding to the discharge rate of the pump 3) to be zero through a drive control to the pump 3, which is capable of controlling the flow rate of the coolant flowing through the internal combustion engine 1. Hence, when the coolant in the internal combustion engine 1 is nucleate boiling while the flow of the coolant through the internal combustion engine 1 is restricted, the maintaining condition of such a restriction can be realized by maintaining a condition in which the discharge rate of the coolant by the pump 3 is decreased to be zero. Moreover, the pump 3 is also utilized as a pump that circulates the coolant in the circulation passage 2. Thus it is unnecessary to newly provide a component like a valve that restricts the flow of the coolant through the internal combustion engine 1. The warm-up acceleration device can be downsized by an amount corresponding to the unnecessary new component, which facilitates mounting of the warm-up acceleration device on a vehicle.

Second Embodiment

Next, a description will be given of a second embodiment of the present invention with reference to FIG. 4.

According to this embodiment, the flow of coolant through an internal combustion engine 1 is restricted by a flow control valve.

Figure 4:
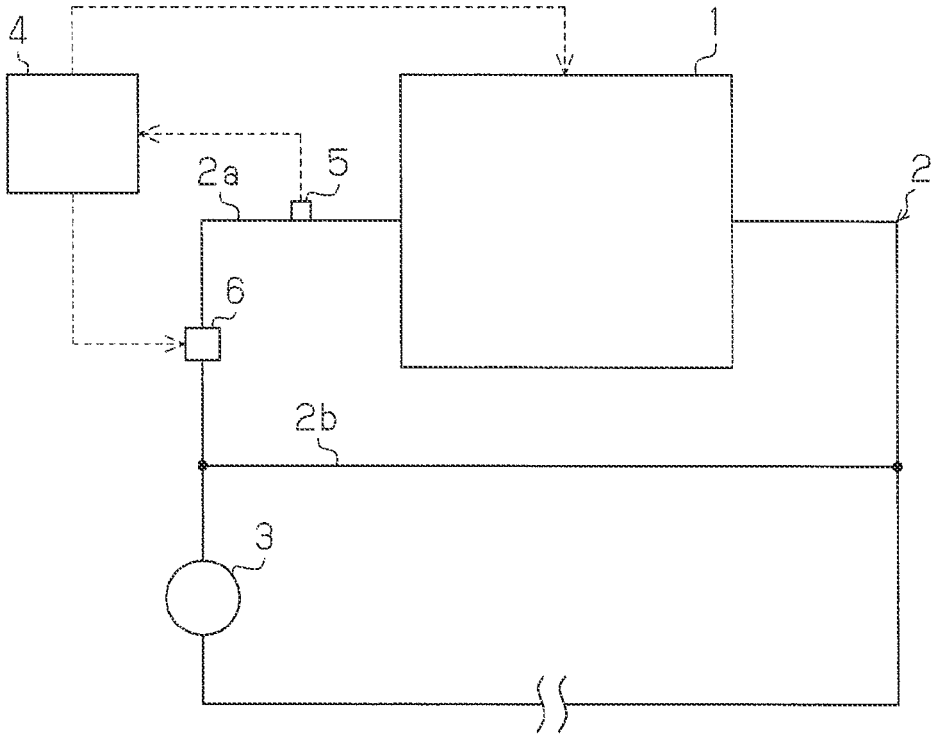
FIG. 4 is a schematic diagram illustrating a whole warm-up acceleration device according to a second embodiment.

As illustrated in FIG. 4, according to this embodiment, a portion of the circulation passage 2 downstream to the pump 3 is branched to a main passage 2*a* passing through the internal combustion engine 1 and a bypass passage 2*b*, which bypasses the internal combustion engine 1. The main passage 2*a* and the bypass passage 2*b* are merged at a part the circulation passage 2 downstream to the internal combustion engine 1. Hence, the coolant in the circulation passage 2 can be circulated through both of the main passage 2*a* and the bypass passage 2*b* upon driving of the pump 3. Unlike the first embodiment, the pump 3 does not necessarily need to be an electric water pump, and a mechanical water pump directly driven by the internal combustion engine 1 is applicable.

The main passage 2*a* is provided with an electrically controlled flow control valve 6, which controls the flow rate of the coolant flowing through the internal combustion engine 1. The flow control valve 6 has the opening degree adjusted through a drive control by the electronic control device 4, thereby controlling the flow rate of the coolant flowing through the main passage 2*a* (internal combustion engine 1). The flow control valve 6 and the electronic control device 4 serve as a controller that controls the flow of the coolant through the internal combustion engine 1. When the opening degree of the flow control valve 6 is changed to control the flow rate of the coolant flowing through the main passage 2*a* (internal combustion engine 1), the ratio between the flow rate of the coolant flowing through the main passage 2*a* and the flow rate of the coolant flowing through the bypass passage 2*b* is changed in accordance with the opening degree of the flow control valve 6.

When the system pressure P detected by the pressure sensor 5 is less than the determination value Pa, the electronic control device 4 restricts the flow of the coolant through the internal combustion engine 1 in order to accelerate the warm-up of the internal combustion engine 1. More specifically, by driving the flow control valve 6 in the closing direction, the flow rate of the coolant flowing through the internal combustion engine 1 is reduced to be zero. In this case, the flow control valve 6 is driven in the closing direction until it becomes a fully closed state. Moreover, when the system pressure P becomes equal to or greater than the determination value Pa, the electronic control device 4 cancels the flow restriction of the coolant through the internal combustion engine 1 in order to suppress film boiling of the coolant in the internal combustion engine 1. More specifically, the flow control valve 6 driven in the closing direction is driven in the opening direction, thereby increasing the flow rate of the coolant flowing through the internal combustion engine 1 to be a value greater than zero, e.g., a value appropriate for the engine operation at this time.

According to this embodiment, in addition to the advantages (1) to (3) of the first embodiment, the following advantage is achieved.

(5) The flow restriction of the coolant through the internal combustion engine 1 is realized by reducing the flow rate to be zero through the drive control (opening degree control) to the flow control valve 6, which is capable of controlling the flow rate of the coolant flowing through the internal combustion engine 1. Hence, when the coolant in the internal combustion engine 1 is nucleate boiling while the flow of the coolant through the internal combustion engine 1 is restricted, the restriction can be maintained by maintaining a condition in which the flow control valve 6 is driven in the closing direction.

Third Embodiment

Next, a description will be given of a third embodiment of the present invention with reference to FIGS. 5 and 6.

Figure 5:
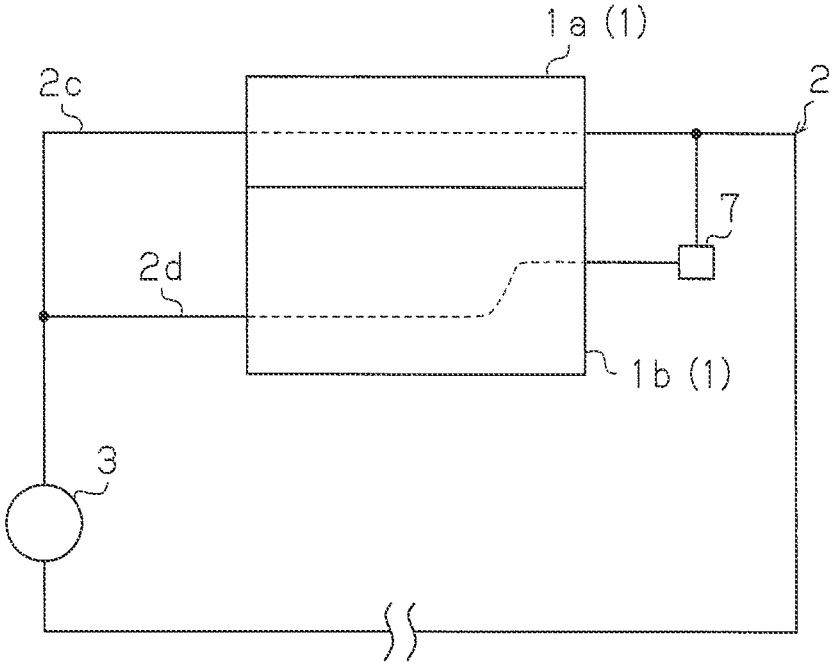
FIG. 5 is a schematic diagram illustrating a whole warm-up acceleration device according to a third embodiment.
Figure 6:
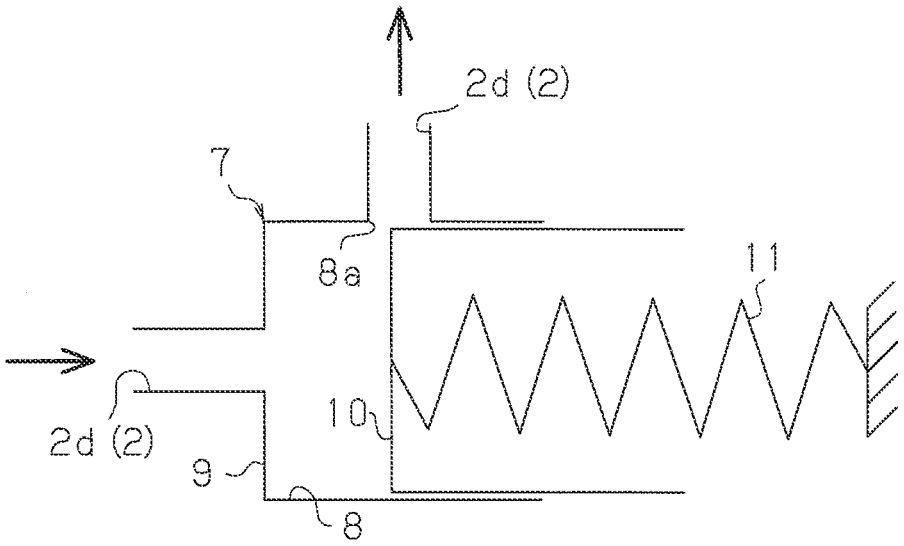
FIG. 6 is a schematic diagram illustrating the internal structure of a pressure valve in the warm-up acceleration device of the third embodiment.

As illustrated in FIG. 5, a circulation passage 2 of this embodiment is branched to a first passage 2*c* passing through a cylinder head 1*a* of the internal combustion engine 1 and a second passage 2*d* passing through a cylinder block 1*b* of the internal combustion engine 1 at the downstream side to the pump 3. The first passage 2*c* and the second passage 2*d* are merged at the downstream side to the internal combustion engine 1. In the internal combustion engine 1, the temperature of the cylinder head 1*a* is easily increased due to heat from combustion gas in a combustion chamber. In contrast, the temperature of the cylinder block 1*b* is not easily increased since it receives little heat from the combustion gas. Accordingly, it is desirable to cool the cylinder head 1*a*, the temperature of which is easily increased, while at the same time, to accelerate the warm-up of the cylinder block 1*b*, the temperature of which is not easily increased.

In order to realize the desirable configuration, a pressure valve 7 is provided at a location downstream side of the cylinder block 1*b* in the second passage 2*d*. The pressure valve 7 controls the flow rate of the coolant flowing through the cylinder block 1*b* (second passage 2*d*). The pressure valve 7 has the opening degree adjusted in accordance with the pressure (system pressure P) in the circulation passage 2, and the flow rate of the coolant flowing through the cylinder block 1*b* (second passage 2*d*) of the internal combustion engine 1 is controlled through the opening degree adjustment. The pressure valve 7 serves as a controller that controls the flow rate of the coolant flowing through the cylinder block 1*b* when driven in the closing direction.

More specifically, when the pressure (system pressure P) in the circulation passage 2 is less than the determination value Pa, the pressure valve 7 is driven in the closing direction based on such a pressure, and thus the flow rate of the coolant flowing through the cylinder block 1*b* is reduced to be zero. In this case, the pressure valve 7 is driven in the closing direction until it becomes the fully closed state. Accordingly, the flow of the coolant through the cylinder block 1*b* is restricted, and thus the warm-up of the cylinder block 1*b* is accelerated. Moreover, as described above, when the pressure (system pressure P) in the circulation passage 2 becomes equal to or greater than the determination value Pa, the pressure valve 7, which has been driven in the closing direction, is driven in the opening direction based on such a pressure, and cancels the flow restriction of the coolant through the cylinder block 1*b*. At this time, the pressure valve 7 driven in the opening direction increases the flow rate of the coolant through the cylinder block 1*b* to be a value greater than zero, e.g., an appropriate value for the engine operation at this time.

Next, the structure of the pressure valve 7 will be described with reference to FIG. 6.

As illustrated in this drawing, the pressure valve 7 includes a housing 9 with a pressure chamber 8 in communication with the second passage 2*d*, a valve body 10 provided in the housing 9 in a displaceable manner and making the volume of the pressure chamber 8 variable based on such a displacement, and a spring 11, which pushes the valve body 10 in a direction of reducing the volume of the pressure chamber 8. The valve body 10 of the pressure valve 7 is displaced in a direction of reducing the volume of the pressure chamber 8 in the housing 9 or in a direction of increasing such a volume by force based on pressure (system pressure P) in the pressure chamber 8 in communication with the second passage 2*d* and the pushing force by the spring 11.

More specifically, when the force based on the system pressure P in the pressure chamber 8 is less than the pushing force by the spring 11, the valve body 10 is displaced in the direction of reducing the volume of the pressure chamber 8, i.e., a direction of closing a port 8*a* in communication with the second passage 2*d* in the pressure chamber 8. Moreover, when the force based on the system pressure P in the pressure chamber 8 is greater than the pushing force by the spring 11, the valve body 10 is displaced in the direction of increasing the volume of the pressure chamber 8, i.e., a direction of releasing the port 8*a* of the pressure chamber 8. Hence, the position of the valve body 10 (the opening degree of the pressure valve 7) to the port 8*a* is adjusted based on the magnitude of the system pressure P in the pressure chamber 8, and thus the flow rate of the coolant flowing through the second passage 2*d* is adjusted.

In this example, the pushing force by the spring 11 in the pressure valve 7 is set such that the valve body 10 blocks off the port 8*a* when the system pressure P is less than the determination value Pa to cause the opening degree of the pressure valve 7 to be a fully closed state, and the valve body 10 releases the port 8*a* when the system pressure P is equal to or greater than the determination value Pa to cause the opening degree of the pressure valve 7 to be a value in the open side rather than the fully closed state. By setting the pushing force by the spring 11 in this manner, in the condition in which the flow of the coolant through the cylinder block 1*b* is restricted, when such a restriction is maintained until the maintaining time t has elapsed after the coolant in the cylinder block 1*b* starts nucleate boiling, the maintaining time t becomes the same period as that of the first embodiment. When the maintaining time t has elapsed, like the first embodiment, the flow restriction of the coolant through the cylinder block 1*b* is canceled.

According to this embodiment, in addition to the advantages (1) to (3) of the first embodiment, the following advantages are achieved.

(6) Flow restriction of the coolant through the cylinder block 1*b* by driving the pressure valve 7 in the closing direction enables effective warm-up (temperature rise) of the cylinder block 1*b*, the temperature of which is hard to increase. Moreover, as described above, while the flow of the coolant through the cylinder block 1*b* is restricted, the coolant in the first passage 2*c* flows through the cylinder head 1*a*, and thus the cylinder head 1*a*, the temperature of which is easily increased, can be cooled by the coolant. Hence, the cylinder block 1*b*, the temperature of which is not easily increased, can be effectively warmed up while the cylinder head 1*a*, the temperature of which is easily increased, is cooled.

(7) The pressure valve 7 receives the pressure in the circulation passage 2 to be driven in the closing direction when the pressure (system pressure P) is less than the determination value Pa. Hence, when the system pressure P is a value indicating the occurrence of nucleate boiling of the coolant in the cylinder block 1*b*, the pressure valve 7 is driven in the closing direction, and the flow of the coolant through the cylinder block 1*b* is restricted. As a result, during nucleate boiling until the maintaining time t has elapsed after the coolant in the cylinder block 1*b* starts nucleate boiling while the flow of the coolant through the cylinder block 1*b* is restricted, the flow restriction of the coolant through the cylinder block 1*b* is maintained by the pressure valve 7. The maintaining time t is set to be a period at which the system pressure P indicates the occurrence of nucleate boiling based on the spring 11 of the pressure valve 7. By restricting the flow of the coolant through the cylinder block 1*b* using the pressure valve 7 during the maintaining time t, the flow restriction of the coolant through the cylinder block 1*b* can be maintained while nucleate boiling is occurring. Moreover, such a restriction is realized without, for example, pressure detection by a pressure sensor, and thus it becomes unnecessary to provide a pressure sensor. Furthermore, the manufacturing costs of the warm-up acceleration device can be reduced by an amount corresponding to the unnecessary pressure sensor, as described above.

(8) The pressure valve 7 can be driven by itself without a power supply thereto. Hence, with the power supply to respective components of the vehicle being stopped after the vehicle stops, when the coolant in the cylinder block 1*b* of the internal combustion engine 1 receives heat from the internal combustion engine 1 and is subjected to a temperature rise, the pressure valve 7 is driven in the opening direction if the system pressure P is equal to or greater than the determination value Pa. When the pressure valve 7 is driven in the opening direction in this manner, it becomes possible to release the high-temperature coolant in the cylinder block 1*b* to the exterior through the convection of heat due to a difference in the temperature of the coolant in the second passage 2*d*. By releasing the high-temperature coolant in the cylinder block 1*b* to the exterior in this manner, it becomes possible to suppress film boiling of the coolant in the cylinder block 1*b* under the above-described circumstance.

Fourth Embodiment

Figure 7:
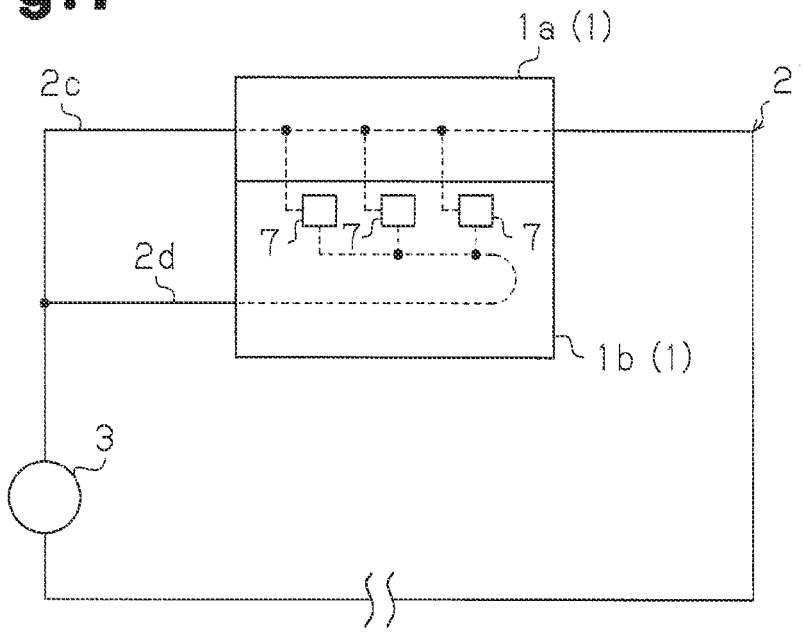
FIG. 7 is a schematic diagram illustrating a whole warm-up acceleration device according to a fourth embodiment.
Figure 8:
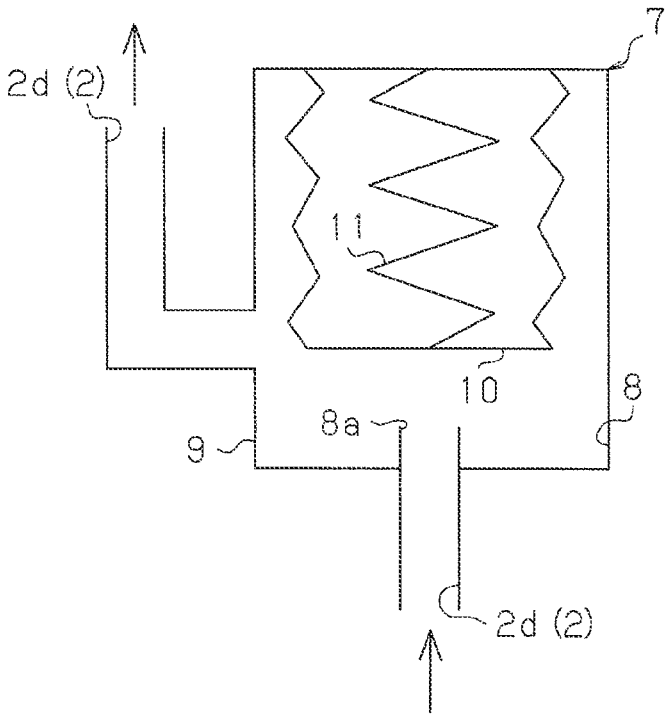
FIG. 8 is a schematic diagram illustrating an internal structure of a pressure valve in the warm-up acceleration device of the fourth embodiment.

Next, a description will be given of a fourth embodiment of the present invention with reference to FIGS. 7 and 8.

This embodiment is a modification of the third embodiment and has pressure valves 7 provided at the internal combustion engine 1. As illustrated in FIG. 7, in a circulation passage 2 of this embodiment, the second passage 2*d* divided into three branches in the cylinder block 1*b* is merged with a portion of the first passage 2*c* in the cylinder head 1*a*. The total of three pressure valves 7 are provided at respective three branches of the second passage 2*d*.

The pressure valves 7 in this case employ the same structure as that of the third embodiment other than the shape. More specifically, as illustrated in FIG. 8, each pressure valve 7 includes a housing 9 including a pressure chamber 8 in communication with a second passage 2*d*, a valve body 10 provided in the housing 9 in a displaceable manner and making the volume of the pressure chamber 8 variable in accordance with a displacement, and a spring 11, which pushes the valve body 10 in a direction of reducing the volume of the pressure chamber 8. The valve body 10 of the pressure valve 7 is displaced in the housing 9 in a direction of reducing the volume of the pressure chamber 8 or in a direction of increasing the volume in accordance with force based on the pressure (system pressure P) in the pressure chamber 8 in communication with the second passage 2*d* and the pushing force by the spring 11, thereby blocking or releasing the port 8*a*. According to the pressure valves 7 of this embodiment, the pushing force by the spring 11 is set like the third embodiment.

According to this embodiment, in addition to the advantages of the third embodiment, the following advantage is further achieved.

(9) The second passage 2*d* is divided into three branches in the cylinder block 1*b* and merged with a portion of the first passage 2*c* in the cylinder head 1*a*, and the three branches of the second passage 2*d* are each provided with a pressure valve 7. Hence, when the pressure valves 7 cancel the flow restriction of the coolant through the cylinder block 1*b*, even if the high-temperature coolant present in the cylinder block 1*b* in the second passage 2*d* flows in the cylinder head 1*a* (first passage 2*c*), the flow is divided. As a result, when the high-temperature coolant flows in the cylinder head 1*a* as described above, it becomes possible to suppress a partial temperature rise of the cylinder head 1*a* due to the flow-in of the coolant.

Fifth Embodiment

Next, a description will be given of a fifth embodiment of the present invention with reference to FIGS. 9 and 10.

Figure 9:
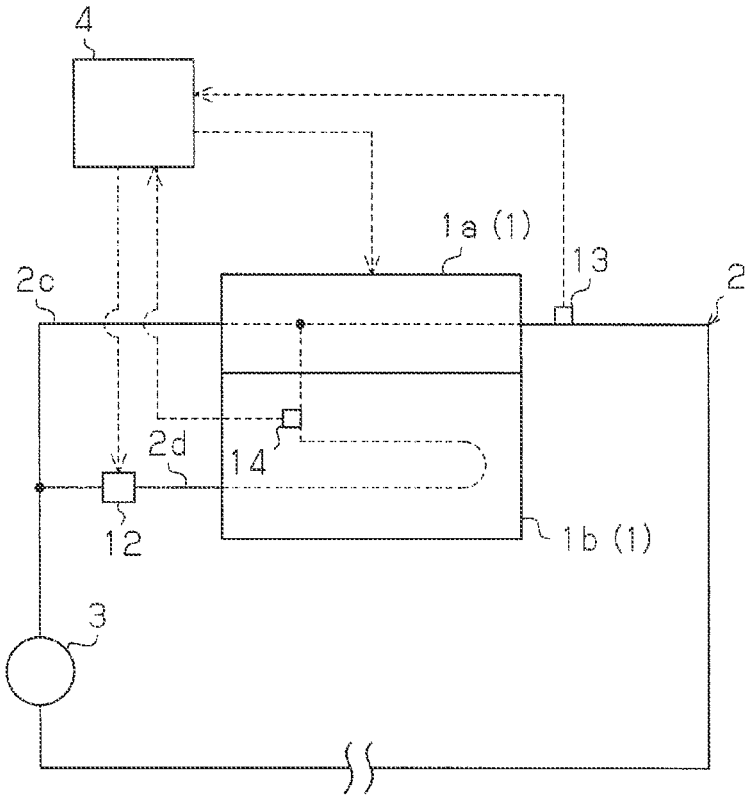
FIG. 9 is a schematic diagram illustrating a whole warm-up acceleration device according to a fifth embodiment.
Figure 10:
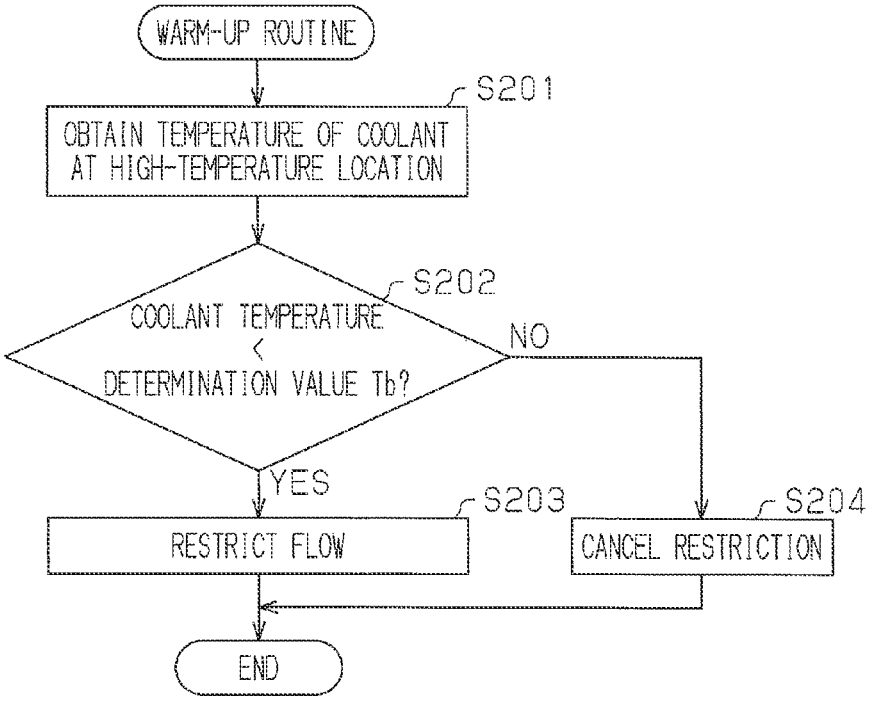
FIG. 10 is a flowchart illustrating procedures of restricting the flow of a coolant through an internal combustion engine and canceling such a restriction according to the fifth embodiment.

As illustrated in FIG. 9, a circulation passage 2 of this embodiment is branched to, at the downstream side of the pump 3, a first passage 2*c* passing through the cylinder head 1*a* of the internal combustion engine 1, and a second passage 2*d* passing through the cylinder block 1*b* of the internal combustion engine 1. Moreover, the second passage 2*d* is merged with a portion of the first passage 2*c* in the cylinder head 1*a* in the internal combustion engine 1. Furthermore, an electrically controlled flow control valve 12, which controls the flow rate of the coolant flowing through the cylinder block 1*b* (second passage 2*b*), is provided in the second passage 2*d* at the upstream side of the cylinder block 1*b*. The flow control valve 12 has the opening degree adjusted through the drive control by the electronic control device 4, and thus the flow rate of the coolant through the second passage 2*d* (cylinder block 1*b*) is controlled. The flow control valve 12 and the electronic control device 4 serve as a controller that controls the flow of the coolant in the second passage 2*d* through the cylinder block 1*b*.

The electronic control device 4 receives a detection signal from a first coolant temperature sensor 13, which detects the temperature of the coolant at the outlet of the cylinder head 1*a* in the first passage 2*c*, and a detection signal from a second coolant temperature sensor 14, which detects the temperature of the coolant in the cylinder block 1*b* in the second passage 2*d*. The electronic control device 4 estimates and obtains, based on the detection signal from the first coolant temperature sensor 13 and the detection signal from the second coolant temperature sensor 14, the temperature of the coolant at a location where the temperature at a portion of the second passage 2*d* in the cylinder block 1*b* becomes the highest (hereinafter, referred to as a "high-temperature location"). Next, the electronic control device 4 drives and controls the flow control valve 12 based on the temperature of the coolant at the high-temperature location to accelerate the warm-up of the internal combustion engine 1 (cylinder block 1*b*), more specifically, the opening degree control on the flow control valve 12 to restrict the flow of the coolant in the second passage 2*d* through the cylinder block 1*b* and to cancel such a restriction.

The drive control on the flow control valve 12 will be described with reference to the flowchart of FIG. 12 illustrating a warm-up routine. The warm-up routine is periodically executed by the electronic control device 4 through, for example, a time interruption for each predetermined time cycle.

In this routine, first, the temperature of the coolant at the high-temperature location in the second passage 2*d* is obtained based on the detection signal from the first coolant temperature sensor 13 and the detection signal from the second coolant temperature sensor 14 (S201). Next, it is determined whether or not the temperature of the coolant at the high-temperature location is lower than a determination value Tb (S202). When the determination result in this step is positive, the flow of the coolant through the cylinder block 1*b* is restricted in order to accelerate the warm-up of the cylinder block 1*b* (S203). More specifically, the electronic control device 4 drives the flow control valve 12 in the closing direction, thereby decreasing the flow rate of the coolant flowing through the cylinder block 1*b* to be zero. In this case, the flow control valve 12 is driven in the closing direction until it becomes completely closed. When the determination result in the step S202 is negative, the flow restriction of the coolant through the cylinder block 1*b* is canceled in order to suppress film boiling of the coolant in the cylinder block 1*b* (S204). More specifically, the flow control valve 12 driven in the closing direction is driven in the opening direction by the electronic control device 4, thereby increasing the flow rate of the coolant flowing through the cylinder block 1*b* to be a value greater than zero, e.g., an appropriate value for the engine operation at this time.

The determination value Tb used in the step S202 is set in advance, for example, through experimentation, in such a manner as to be a value corresponding to the temperature of the coolant at the high-temperature location at a time point when the boiling state of the coolant at the high-temperature location in the cylinder block 1*b* shifts from nucleate boiling to film boiling. By setting the determination value Tb in this manner, the flow of the coolant through the cylinder block 1*b* is restricted before the coolant in the cylinder block 1*b* of the internal combustion engine 1 during a warm-up starts film boiling. Moreover, during nucleate boiling until the maintaining time t defined by the determination value Tb has elapsed after the coolant in the cylinder block 1*b* (more specifically, at the high-temperature location) starts nucleate boiling in the restricted state, the flow restriction of the coolant through the cylinder block 1*b* is maintained. The maintaining time t is a period at which the temperature of the coolant at the high-temperature location is a value indicating the occurrence of nucleate boiling of the coolant, more specifically, a period until the boiling state of the coolant shifts film boiling after the coolant starts nucleate boiling based on the determination value Tb defined as described above. Next, when the maintaining time t has elapsed after nucleate boiling of the coolant at the high-temperature location starts, i.e., when the temperature of the coolant at the high-temperature location becomes equal to or higher than the determination value Tb, the flow restriction of the coolant through the cylinder block 1*b* is canceled.

According to this embodiment, in addition to the advantage (1) of the first embodiment and the advantage (6) of the third embodiment, the following advantages are achieved.

(10) The maintaining time t is set to be, based on the determination value Tb, a period at which the temperature of the coolant at the high-temperature location in the cylinder block 1*b* is a value indicating the occurrence of nucleate boiling of the coolant. The temperature of the coolant at the high-temperature location has a correlation with nucleate boiling of the coolant. Hence, when the maintaining time t is set to be a period at which the temperature of the coolant is a value indicating the occurrence of nucleate boiling and the flow of the coolant through the cylinder block 1*b* is restricted during that maintaining time t, the flow restriction of the coolant through the cylinder block 1*b* can be maintained while nucleate boiling is occurring.

(11) The maintaining time t is set to be, based on the determination value Tb, a period at which the temperature of the coolant at the high-temperature location is a value indicating the occurrence of nucleate boiling of the coolant, i.e., the period until the boiling state of the coolant shifts to film boiling after nucleate boiling of the coolant occurs. In this case, the flow restriction of the coolant through the cylinder block 1*b* can be maintained over the whole period at which the coolant is nucleate boiling in the cylinder block 1*b* (more specifically, at the high-temperature location). Hence, the restriction can be maintained for a period as long as possible, and the warm-up acceleration effect to the cylinder block 1*b* through such a restriction is maximized.

Other Embodiments

The respective embodiments described above can be modified as follows.

In the first embodiment, as a specific method for restricting the flow of the coolant through the internal combustion engine 1, an exemplary method is described that is for deactivating the pump 3 such that the flow rate of the coolant through the internal combustion engine 1 decreases to zero. However, it is possible to employ a method for decreasing the flow rate of the coolant through the internal combustion engine 1 to be a value greater than zero upon reduction of the discharge rate of the pump 3.

In the first and second embodiments, the determination value Pa is set to be a value corresponding to the pressure in the circulation passage 2 at a time point when the boiling state of the coolant shifts from nucleate boiling to film boiling in the internal combustion engine 1. However, the determination value Pa may be set to be less than such a value to shorten the maintaining time t. In this case, the maintaining time t is set to be a shorter period than the period until the boiling state of the coolant shifts to film boiling after the coolant in the internal combustion engine 1 starts nucleate boiling. In this case, however, the maintaining time t is a period at which the system pressure P is a value indicating the occurrence of nucleate boiling of the coolant in the internal combustion engine 1. This is because such a shorter maintaining time t is a part of the period until the boiling state of the coolant shifts to film boiling after the coolant in the internal combustion engine 1 starts nucleate boiling.

In the first and second embodiments, the maintaining time t may be set to be a period at which the temperature of the coolant in the internal combustion engine 1 is a value indicating the occurrence of nucleate boiling of the coolant. This can be realized as follow. That is, the temperature of the coolant in the internal combustion engine 1 is obtained through actual measurement or estimation. Next, when the obtained temperature is lower than a determination value set in advance that is a value corresponding to the temperature at which the coolant starts nucleate boiling, the flow of the coolant through the internal combustion engine 1 is restricted. In contrast, when the obtained temperature is equal to or higher than the determination value, the flow restriction of the coolant through the internal combustion engine 1 is canceled. The flow restriction of the coolant through the internal combustion engine 1 and the cancelation of such a restriction in this manner permit the maintaining time t to be the above-described period.

In the second embodiment, as a specific method for restricting the flow of the coolant through the internal combustion engine 1, a method may be employed that is for driving the flow control valve 6 in the closing direction to be an opening degree greater than the fully closed state to decrease the flow rate of the coolant flowing through the internal combustion engine 1 to be a greater value than zero.

In the second embodiment, it is not always necessary that the flow control valve 6 be an electrically controlled type. The flow control valve 6 may be a pressure valve that receives the pressure in the circulation passage 2 (the system pressure P). In this case, the flow control valve 6 is driven in the closing direction when the pressure (system pressure P) in the circulation passage 2 is less than the determination value Pa and is also driven in the opening direction when the system pressure P is equal to or greater than the determination value.

In the third and fourth embodiments, as a specific method for restricting the flow of the coolant through the cylinder block 1*b*, a method may be employed that is for driving the pressure valve 7 in the closing direction to be an opening degree greater than the fully closed state to decrease the flow rate of the coolant through the cylinder block 1*b* to be a value greater than zero.

In the third and fourth embodiments, the pushing force by the spring 11 in the pressure valve 7 may be set such that the pressure valve 7 is driven in the closing direction when the system pressure P is less than the determination value Pa, and the pressure valve 7 is driven in the opening direction when the system pressure P is equal to or greater than the determination value Pa. In this case, the maintaining time t is set to be a shorter period than the period until the boiling state of the coolant shifts to film boiling after the coolant in the cylinder block 1*b* starts nucleate boiling. In this case, however, the maintaining time t becomes a period at which the system pressure P is a value indicating the occurrence of nucleate boiling of the coolant in the cylinder block 1*b*.

In the fourth embodiment, it is not always necessary to divide the second passage 2*d* into three branches and merge the branches with the first passage 2*c*. Instead, the second passage 2*d* may be directly merged with the first passage 2*c* without being branched, or may be merged with the first passage 2*c* while being branched in a number other than three. In this case, the number of pressure valves 7 is changed in accordance with the number of the branches.

In the fifth embodiment, as a specific method for restricting the flow of the coolant through the cylinder block 1*b*, a method may be employed that is for driving the flow control valve 12 in the closing direction to be an opening degree greater than the fully closed state to decrease the flow rate of the coolant through the cylinder block 1*b* to be a value greater than zero.

In the fifth embodiment, the determination value Tb is set to be a value corresponding to the temperature of the coolant at a time when the boiling state of the coolant in the cylinder block 1*b* shifts to film boiling from nucleate boiling, but may be set to be a value less than such a value to shorten the maintaining time t. In this case, the maintaining time t is set to be a shorter period than the period until the boiling state of the coolant shifts to film boiling after the coolant in the cylinder block 1*b* starts nucleate boiling. In this case, however, the maintaining time t is a period at which the temperature of the coolant in the cylinder block 1*b* is a value indicating the occurrence of nucleate boiling of the coolant.

In the fifth embodiment, the second coolant temperature sensor 14 may be omitted. In this case, the temperature of the coolant at the high-temperature location in the cylinder block 1*b* in the second passage 2*d* may be estimated and obtained based on the detection signal from the first coolant temperature sensor 13, the engine operation conditions, such as the engine speed and the engine load, and the drive condition of the pump 3 like the discharge rate of the coolant by the pump 3.

In the fifth embodiment, the maintaining time t may be a period at which the temperature of the coolant at the high-temperature location in the cylinder block 1*b* in the second passage 2*d* is a value indicating the occurrence of nucleate boiling of the coolant. This can be realized as follow. That is, the system pressure P of the circulation passage 2 is obtained based on a pressure sensor or the like. Next, when the obtained system pressure P is less than a determination value that is a value defined in advance as a value corresponding to a temperature at which the coolant at the high-temperature location starts nucleate boiling, the flow of the coolant through the cylinder block 1*b* is restricted. In contrast, when the obtained system pressure P is equal to or greater than the determination value, the flow restriction of the coolant through the cylinder block 1*b* is canceled. Such a flow restriction of the coolant through the cylinder block 1*b* and cancelation of the restriction permit the maintaining time t to be the above-described period.

In the fifth embodiment, the flow control valve 12 may be provided at a portion of the second passage 2*d* passing through the cylinder block 1*b*.

DESCRIPTION OF THE REFERENCE NUMERALS

1*a* Internal combustion engine
1*a* Cylinder head
1*b* Cylinder block
2 Circulation passage
2*a* Main passage
2*b* Bypass passage
2*c* First passage
2*d* Second passage
3 Pump
4 Electronic control device
5 Pressure sensor
6 Flow control valve
7 Pressure valve
8 Pressure chamber
8*a* Port
9 Housing
10 Valve body
11 Spring
12 Flow control valve
13 First coolant temperature sensor
14 Second coolant temperature sensor

The invention claimed is:

1. A warm-up acceleration device for an internal combustion engine, the device comprising:

a circulation passage that causes a coolant to circulate to flow through the internal combustion engine; and a controller that controls the flow of the coolant through the internal combustion engine, wherein, when the internal combustion engine is warmed up, the controller restricts the flow of the coolant through the internal combustion engine, wherein the controller maintains the restriction while the coolant in the internal combustion engine is nucleate boiling while the flow of the coolant through the internal combustion engine is restricted, and wherein the controller is configured to fix a flow rate of the coolant flowing through the internal combustion engine while the controller maintains the restriction.

2. The warm-up acceleration device according to claim 1, wherein the controller restricts the flow of the coolant through the internal combustion engine when a pressure in the circulation passage is less than a determination value Pa, and the determination value Pa is set in such a manner as to be equivalent to the pressure in the circulation passage at the time point when the boiling state of the coolant in the internal combustion engine shifts from nucleate boiling to film boiling.

3. The warm-up acceleration device according to claim 2, wherein the controller is a pressure valve that controls the flow rate of the coolant flowing through the internal combustion engine based on pressure in the circulation passage, and the pressure valve receives pressure in the circulation passage and is driven in the closing direction when the pressure in the circulation passage is less than the determination value Pa, thereby restricting the flow restriction of the coolant through the internal combustion engine.

4. The warm-up acceleration device according to claim 1, wherein the controller restricts the flow of the coolant through the internal combustion engine when a temperature of coolant of the internal combustion engine is less than a determination value Tb, and the determination value Tb is set in such a manner as to be equivalent to the temperature of the coolant of the internal combustion engine at a time point when the boiling state of the coolant in the internal combustion engine shifts from nucleate boiling to film boiling.

5. The warm-up acceleration device according to claim 1, wherein the controller includes a flow control valve that controls the flow rate of the coolant flowing through the internal combustion engine, and the controller drives the flow control valve in the closing direction when restricting the flow of the coolant through the internal combustion engine.

6. The warm-up acceleration device according to claim 1, wherein the controller includes a pump that is capable of controlling the flow rate of the coolant flowing through the internal combustion engine, and the controller decreases a discharge rate of the coolant by the pump when restricting the flow of the coolant through the internal combustion engine.

7. The warm-up acceleration device according to claim 1, wherein the circulation passage includes a first passage that passes through a cylinder head of the internal combustion engine and a second passage that passes through a cylinder block of the internal combustion engine, and the controller is adapted to restrict flow of the coolant in the second passage through the cylinder block.

* * * * *